US005491943A

United States Patent [19]

Vondrejs et al.

[11] Patent Number: 5,491,943

[45] Date of Patent: Feb. 20, 1996

[54] FRAME MEMBER FOR SPACE DIVIDERS, SCREENS, SIMILAR PANEL STRUCTURES

[75] Inventors: Frank Vondrejs; Vlad Muller, both of Downsview, Canada

[73] Assignee: Global Upholstery Company, Downsview, Canada

[21] Appl. No.: 201,499

[22] Filed: Feb. 24, 1994

[30] Foreign Application Priority Data

Feb. 25, 1993 [CA] Canada ..... 2090386

[51] Int. Cl.[6] ..... E04B 2/74; A47G 5/00

[52] U.S. Cl. ..... 52/239; 52/36.6; 52/588.1; 52/282.2; 160/135; 160/351

[58] Field of Search ..... 52/282.1–282.3, 52/588.1, 586.1, 583.1, 239, 238.1, 36.4, 36.6, 592.1, 592.6; 160/135, 137, 351

[56] References Cited

U.S. PATENT DOCUMENTS

| | | | |
|---|---|---|---|
| 3,700,385 | 10/1972 | Sherwood | 52/36.6 |
| 3,771,277 | 11/1973 | Rausch et al. | 52/588.1 X |
| 4,021,973 | 5/1977 | Hegg et al. | 52/36.6 |
| 4,215,765 | 8/1980 | Harris . | |
| 4,296,579 | 10/1981 | Prond | 52/36.5 X |
| 4,631,881 | 12/1986 | Charman | 52/238.1 X |
| 4,716,699 | 1/1988 | Crossman et al. | 52/36.6 X |
| 4,905,428 | 3/1990 | Sykes | 52/239 X |
| 4,967,531 | 11/1990 | Giles et al. . | |
| 5,142,997 | 9/1992 | Delong et al. | 52/239 X |
| 5,325,649 | 7/1994 | Kajiwara | 52/586.1 |

FOREIGN PATENT DOCUMENTS

| | | |
|---|---|---|
| 7371574 | 4/1976 | Australia . |
| 2662216 | 5/1990 | France . |
| 1563890 | 4/1980 | United Kingdom . |
| 2246801 | 2/1992 | United Kingdom . |
| 2247257 | 2/1992 | United Kingdom . |
| 2250759 | 6/1992 | United Kingdom . |

*Primary Examiner*—Carl D. Friedman
*Assistant Examiner*—Winnie Yip
*Attorney, Agent, or Firm*—Bereskin & Parr

[57] ABSTRACT

A panel structure, as used for space dividers and other purposes, has an identical frame member at each side. Each frame member comprises an extrusion of the same cross-sectional shape, having on one side surface at least one formation comprising a projection and a recess disposed symmetrically about a median plane which extends longitudinally of the extrusion. The frame members extend vertically at each end of a central portion of the panel with their respective side surfaces facing outwardly. Two adjacent panels are held together by bringing the endmost frame members of the respective panels into contact so that the formations on the respective members interfit. Locking members are then snapped into slots in the respective frame members.

20 Claims, 12 Drawing Sheets

FRAME MEMBER FOR SPACE DIVIDERS, SCREENS, SIMILAR PANEL STRUCTURES

FIELD OF THE INVENTION

This invention relates to frame members, such as are used in space dividers and screens for sub-dividing office and other space, and in other panel structures. In particular, the invention is concerned with frame menders which are intended to be used vertically at the sides of a panel structure, and which are designed to permit two or more such panel structures to be connected together by inter-engaging formations on the frame members.

BACKGROUND OF THE INVENTION

It has been proposed to use at the vertical sides of a divider or screen an extruded, elongate member, which has a particular formation on its sideways facing surface. The formation on one side of one divider engages with the formation on the adjacent side of a further divider. Once the formations are engaged to each other, a locking member may be applied to retain the members and thus the screens together.

Conventionally, two different forms of frame member are required, one being used at one side of the screen and the other being used at the other side.

The use of two different forms of frame member (that is, frame members having different transverse cross-sectional shapes) requires two different dies to make the frame members. Also, in assembling a screen, care must be taken that the correct frame member is used at each side of the screen.

BRIEF DESCRIPTION OF THE INVENTION

The present invention provides a frame member having a particular cross-sectional shape which can be used for both sides of a screen or other panel structure.

The frame member of the invention is of elongate form and has a side surface adapted to co-operate with a like side surface of a second similar frame member. The side surface has at least one formation which extends longitudinally of the member and is of uniform cross-sectional shape throughout its length and which comprises a projection and a complementary recess. The projection and recess are disposed on respectively opposite sides of and symmetrically with respect to a longitudinal median plane of the member which extends normal to said surface. The frame member further includes means for receiving a locking member for maintaining a frame member in side-by-side relationship with a said second similar frame member with the said side surfaces of the respective members in abutment. The formations of the side surfaces of the respective frame members then inter-engage for preventing lateral movement between the members.

Preferably, two U-shaped locking members are employed and fit into laterally directed slots at ends of the side surfaces of the respective frame members.

In conventional arrangements for connecting the two adjacent frame members of a pair of screens, the two frame members are locked together by a locking member which slides longitudinally over formations on the frame members. It is a preferred feature of the present invention that the locking member is applied by sideways movement; that is, movement normal to the longitudinal axis of the frame member.

Additional formations can be provided on the frame member for the attachment of, or the attachment to, other members.

BRIEF DESCRIPTION OF THE DRAWINGS

The invention will be readily understood by the following description of certain embodiments, by way of example, in conjunction with the accompanying drawings, in which.

DESCRIPTION OF THE PREFERRED EMBODIMENTS

Figure 1:
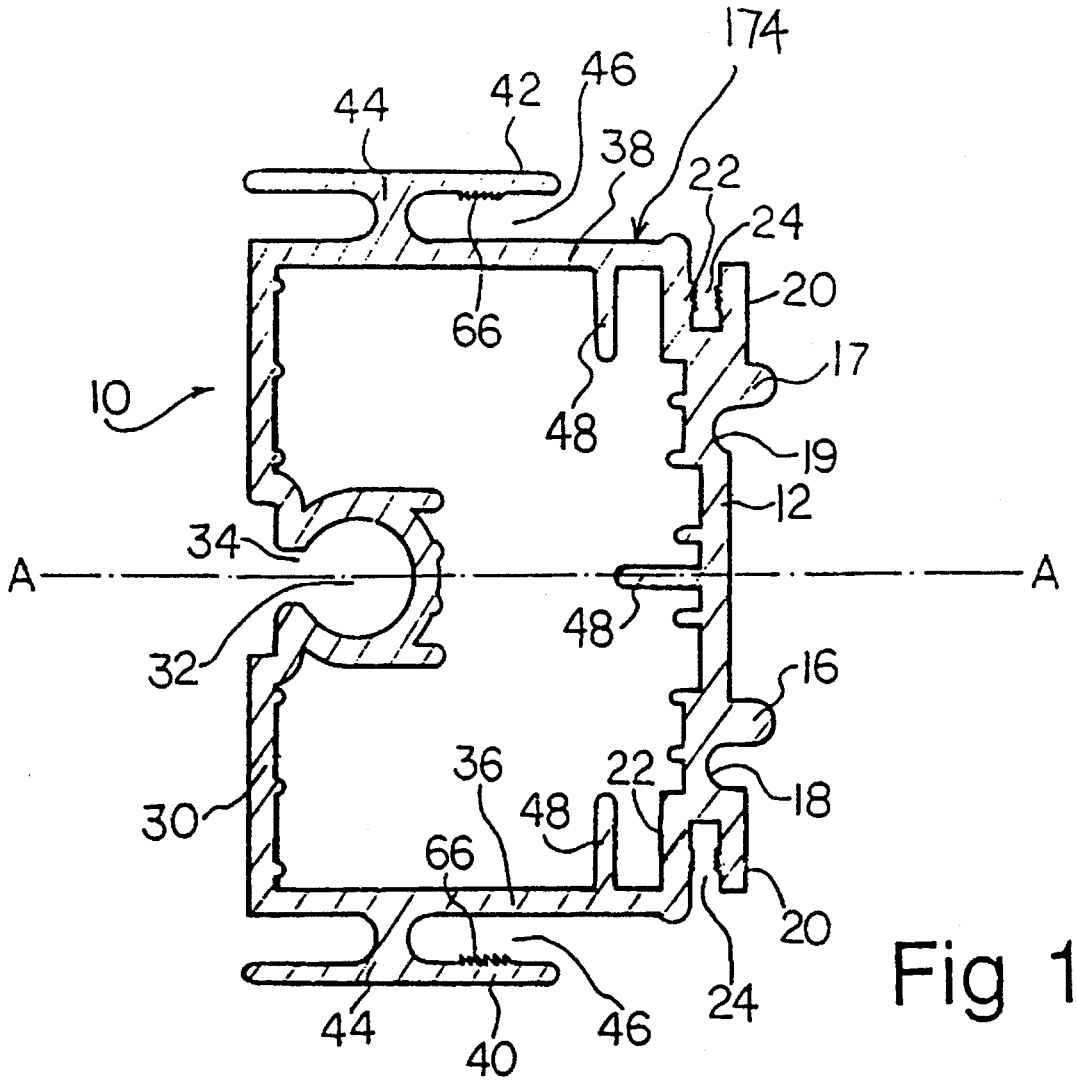
FIG. 1 is a transverse cross-sectional view of one form of frame member in accordance with the present invention.

FIG. 1 illustrates, in transverse cross-section, a frame member 10, which in this example is a hollow metal extrusion. The frame member is elongate, of a length useable as a frame member for a divider or screen, or other panel structure.

Figure 2:
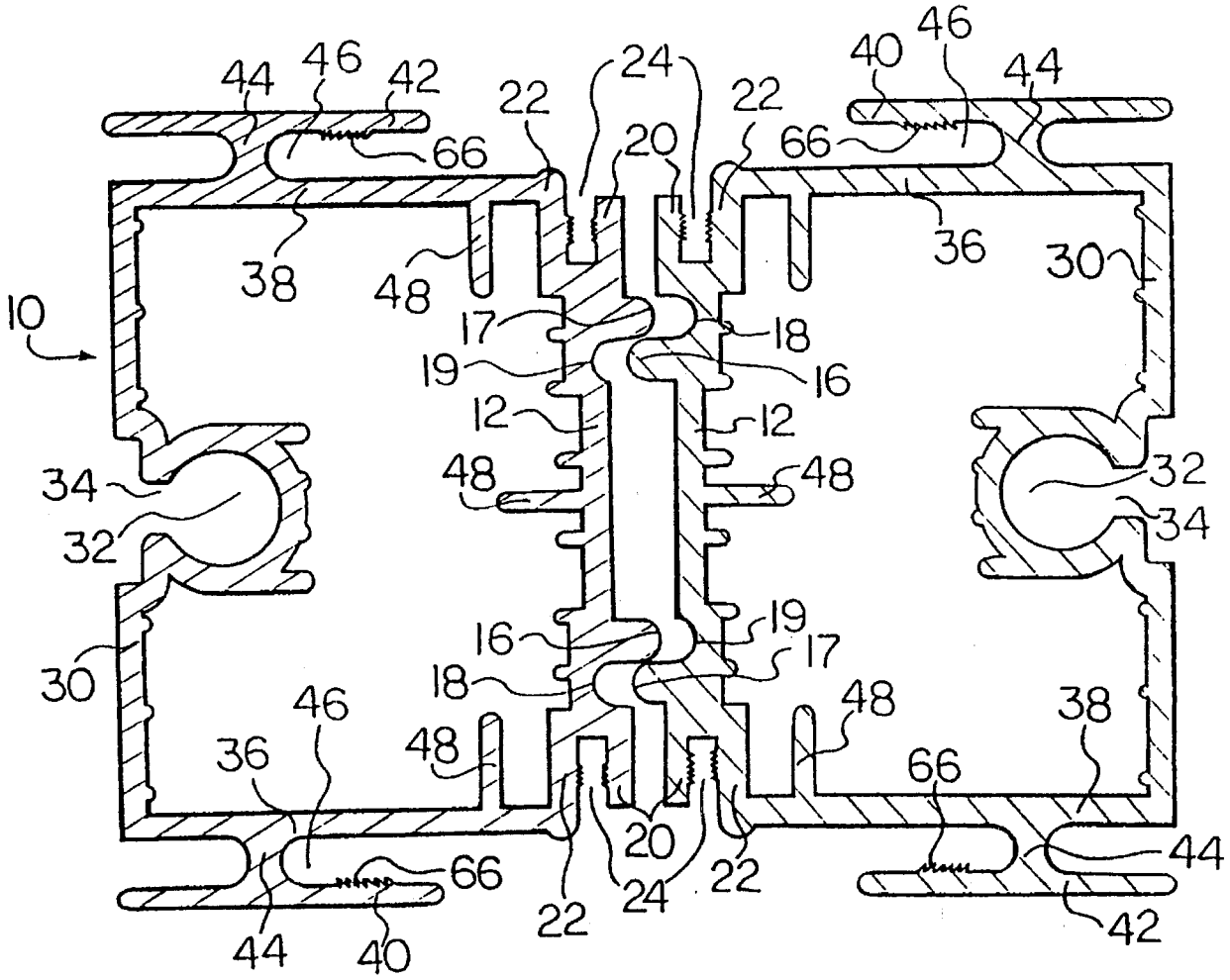
FIG. 2 is a transverse cross-sectional view of two frame members as in FIG. 1, shown in positions immediately before being engaged and locked together.
Figure 3:
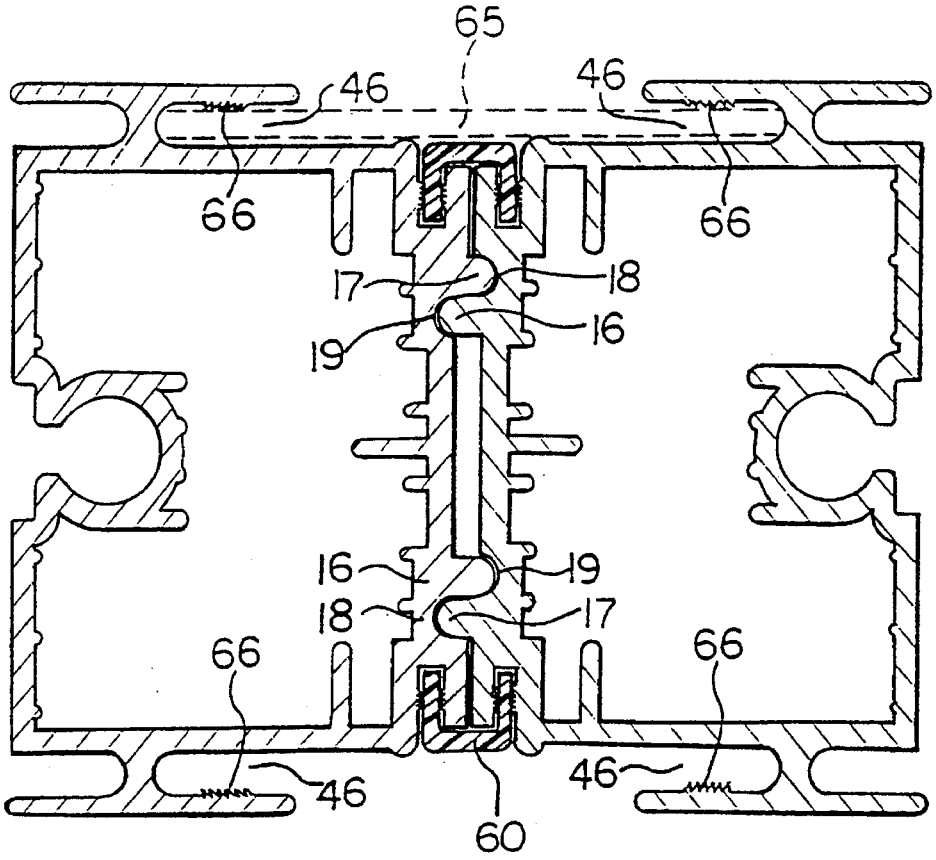
FIG. 3 is a similar view to that of FIG. 2, but with the two frame members in engagement and locked.

Frame member 10 has a side surface 12 adapted to co-operate with a like side surface of a second, similar frame member (see FIGS. 2 and 3). Side surface 12 has two formations, each comprising a projection and a recess respectively. In the example illustrated, projection 17 and recess 18 comprise one such formation and are disposed on respectively opposite sides of and symmetrically with resect to a longitudinal median plane A—A of member 10. Projection 16 and recess 19 comprise a second such formation and are similarly disposed with respect to one another.

At each end of the surface 12 there is a laterally extending web 20, which forms part of surface 12 and is spaced from a wall portion 22 of the extrusion.

Frame member 10 has a side surface 30 opposite surface 12, which is provided with a partially enclosed groove or slot 32, having a narrow neck 34, disposed in plane A—A. On end surfaces 36 and 38 of the extrusion are formed webs 40 and 42, respectively, connected by central ribs 44, to the end surfaces, and forming respective narrow grooves or slots 46 between the webs and the end surfaces 36 and 38.

If desired, various strengthening webs can be formed within the frame member, for example, as shown at 48.

In FIGS. 2 and 3, one length of frame member 10, as in FIG. 1, is positioned to the left. On the right is positioned a further length of the same frame member, which has been turned about its longitudinal axis, so that the side surfaces 12 of the respective frame members confront one another. It will be seen that the formations on the two frame members comprising projections 16, 17 and recesses 18, 19 are then positioned to co-operate and connect the frame members together. This is seen in FIG. 3.

Figure 5:
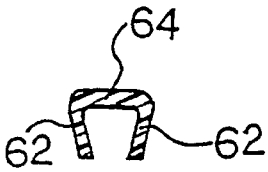
FIG. 5 is an end view of a locking member of FIG. 4.
Figure 4:
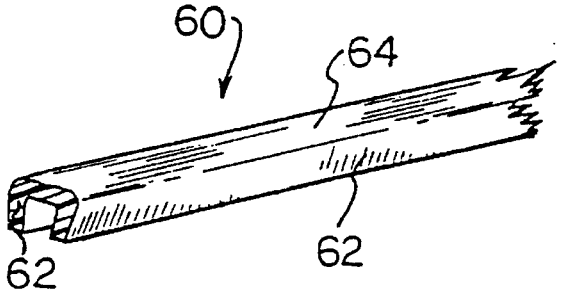
FIG. 4 is a perspective view of the locking member shown in FIG. 3.

Also seen in FIG. 3 is a clip-in locking member 60. Locking member 60 is applied by positioning it opposite the two slots 24 at the ends of the respective side surfaces 12 of the two extrusions, and then pushing the locking member in (which distorts it somewhat). The form of the locking member is seen in FIGS. 4 and 5. It is an elongate channel-shaped member, having legs 62 extending from a back 64. Relaxed (that is not applied) the legs slant inwardly slightly. On pressing the legs into the slots 24, the legs bend outward to grip the extrusions. If desired a ribbed surface can be formed on one or both surfaces of the slots 24 to aid in retaining the locking members. A capping member 65 is shown in dotted outline at one end in FIG. 3. Capping or sealing members can be provided at each end. If desired one or both surfaces of the slots 46 can be ribbed, as shogun at 66.

It will be seen that a neat, symmetrical assembly is provided. The frame members can be attached to dividers, and other members, by means of a rib on the divider sliding into the partially enclosed grooves or slot 32. However, other ways of attaching the frame member can be used.

Figure 6:
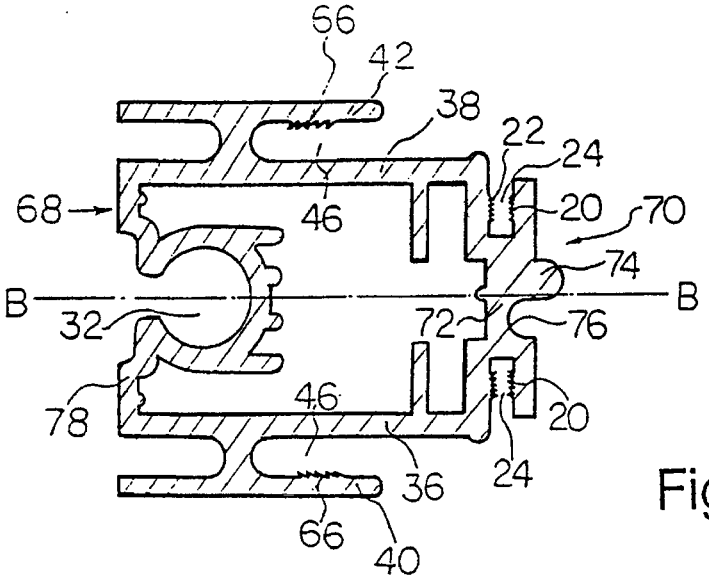
FIG. 6 is a transverse cross-sectional view through another form of frame member in accordance with the present invention.
Figure 7:
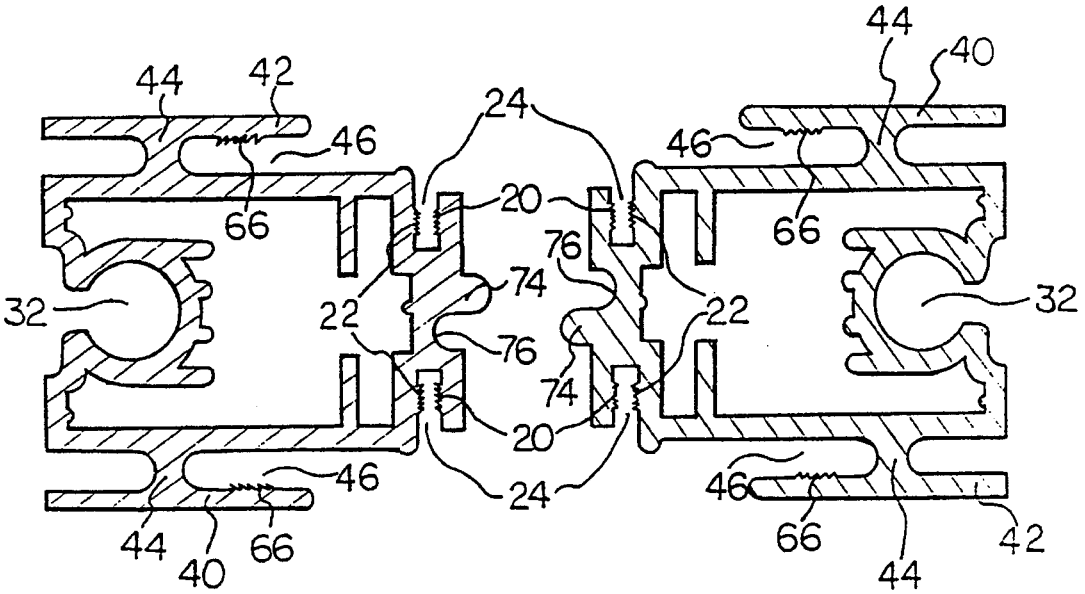
FIG. 7 is a transverse cross-sectional view through two frame members of the form of FIG. 6, shown immediately before being engaged and locked together.
Figure 8:
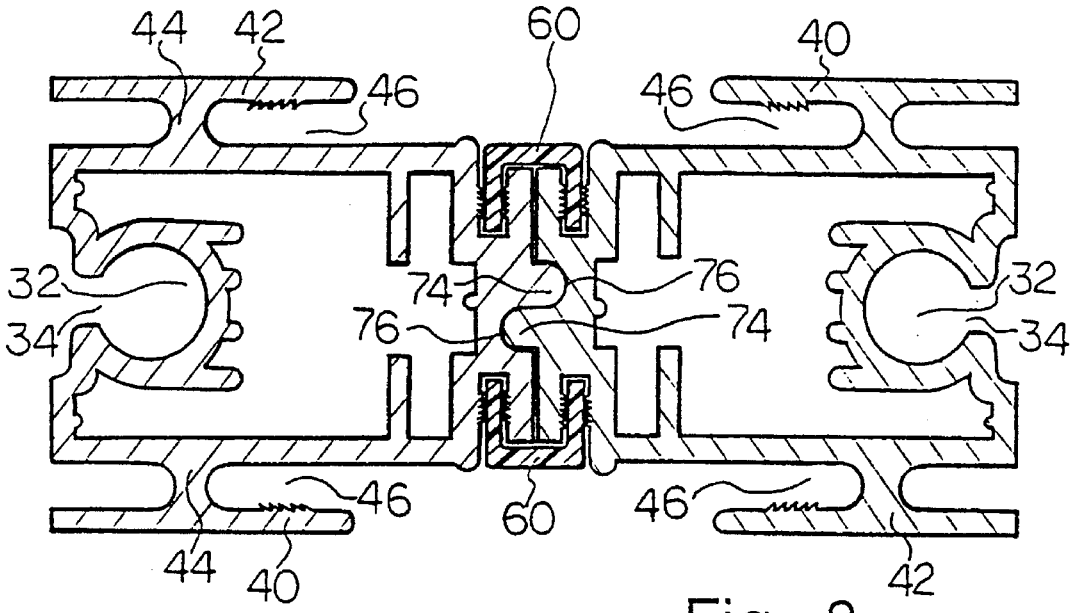
FIG. 8 is a view similar to FIG. 7, but with the two frame members in engagement and locked; and, FIG. 9 is a perspective view showing a panel in accordance with the invention, and part of a further similar panel positioned for connection with the first-mentioned panel.

FIGS. 6, 7 and 8 illustrate a frame member 68 with only one formation 70 comprising a projection 74 and a recess 76 disposed on respectively opposite sides of and symmetrical about a median longitudinal plane B—B. Where applicable, the same reference numerals as those used in FIGS. 1, 2 and 3 have been used to denote like parts. Formation 70 is part of a side surface 72 at each end of which is a laterally extending web 20 and slots 24. A partially enclosed groove or slot 32 is formed in the opposite side surface 78. End surfaces 36 and 38 have webs 40 and 42 forming slots 46.

FIG. 6 illustrates a single frame member, 68, in cross-section. FIG. 7 illustrates a first frame member 68 on the left and a second frame member of the same cross-sectional shape on the right. In FIG. 8 the two frame members are shown in engagement, with the projection 74 on one member in the recess 76 in the other. The two members are locked together by locking members 60.

As described with reference to FIGS. 1, 2 and 3, the frame members 68 are attached to dividers, screens or other panel member at the side surfaces 78 as by a projection extending into the slot 32. Other forms of attachment can be used. Capping strips can be applied, by means of slots 46. Ribbing can be provided at 66.

Normally the formations comprising projections 16, 17 and recesses 18, 19 or 74 and 76 extend for the whole length of a frame member but, if desired, the formations may be intermittent. When the members are extruded, it is usually more convenient to make the formations continuous. The formations are shaped so that only sideways movement is necessary to join the two frame members together, without any longitudinal movement. Similarly the locking member is applied by sideways movement directly into the grooves 24, without any longitudinal movement.

Once locked together by the locking members, a very strong, stable connection is obtained.

Figure 9:
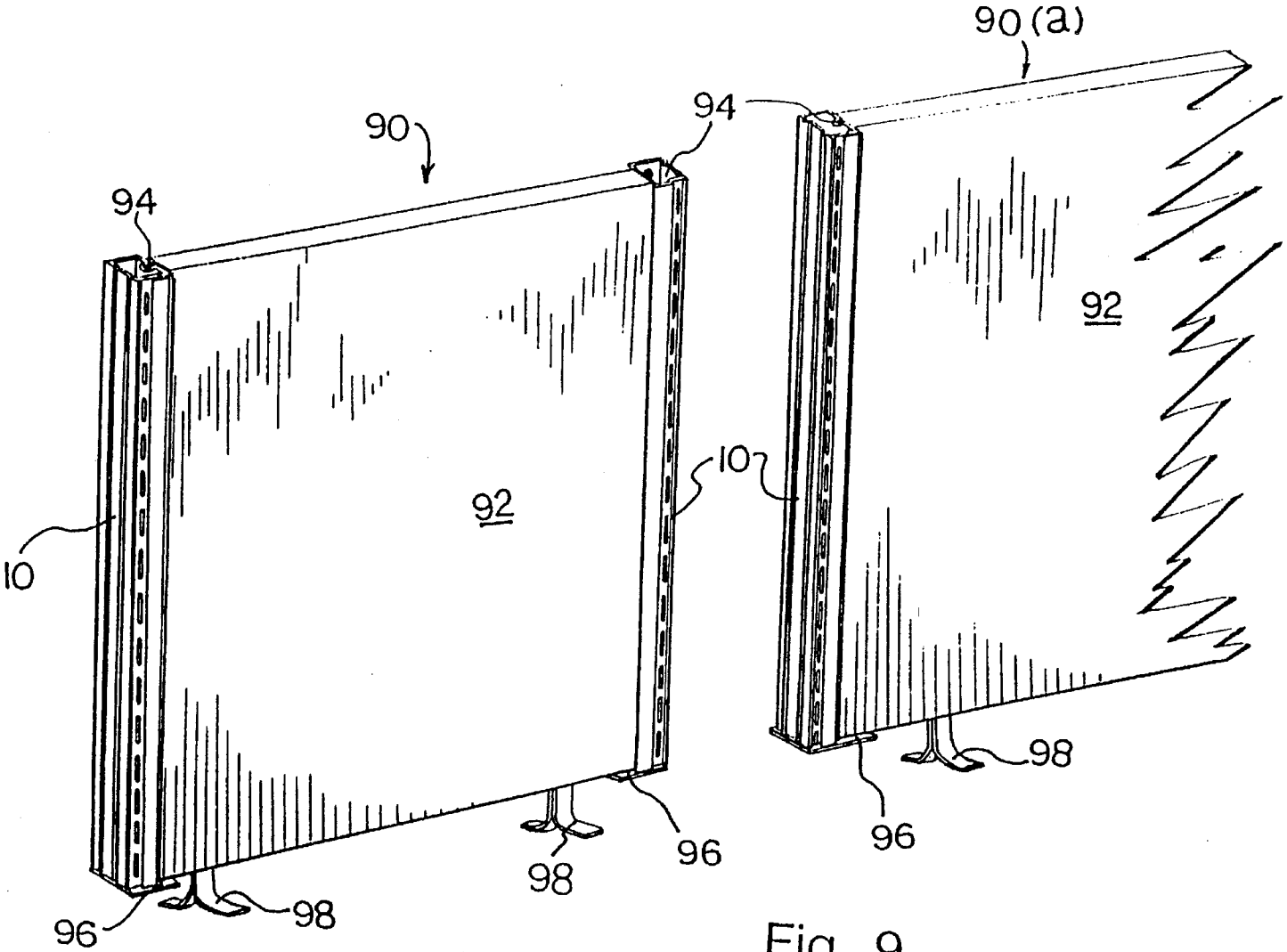

FIG. 9 illustrates a panel structure 90, in the example a divider screen. The panel structure comprises a central panel member 92 having a frame member 10 on each side. The frame members are attached to the panel member by a rib 94 extending down each side of the panel and situated in the grooves 32. To position the frame members relative to the panel a bottom member 96 can be provided at each side. Similar members, or a single long member, can be provided at the top and bottom to complete a frame for the panel. Feet 98 provides for standing the panel on a floor. A further panel structure 90(*a*) is illustrated positioned adjacent to the first panel structure, ready for connection to the panel structure 90. This is effected by moving one panel structure laterally towards the other, engaging the respective formations and pressing locking member (not shown) into the slots 24.

FIGS. 10 to 18 show further embodiments of the invention in which the panel structure incorporates a rigid frame made from vertical frame members of the form shown in FIGS. 1 to 3, together with horizontal frame members at least at the top and bottom of the panel structure. In FIGS. 10 to 18, the vertical frame members that are similar to frame member 10 are denoted 112 and the horizontal frame members are denoted 114.

Figure 11:
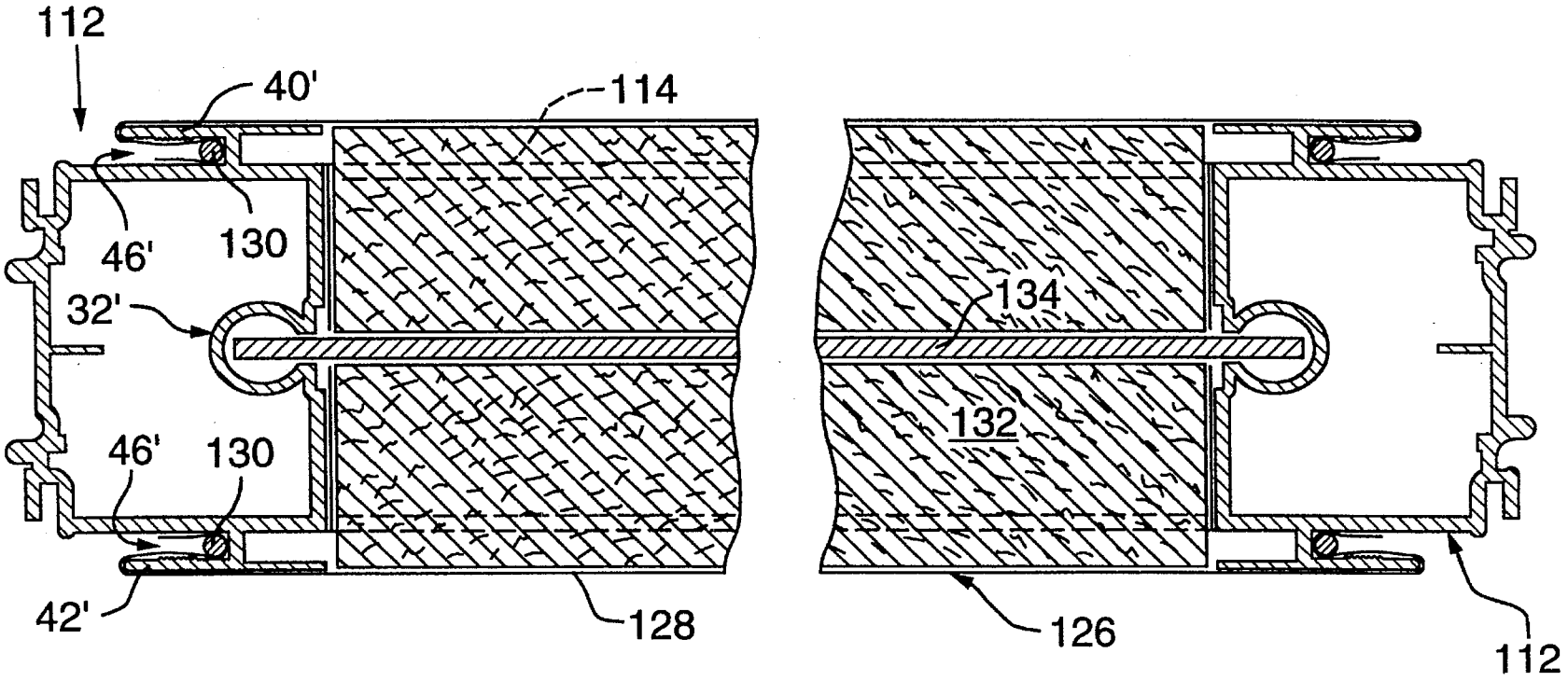
FIGS. 11 and 12 are sectional views on lines: 11—11 and 12—12 of FIG. 10 respectively.
Figure 12:
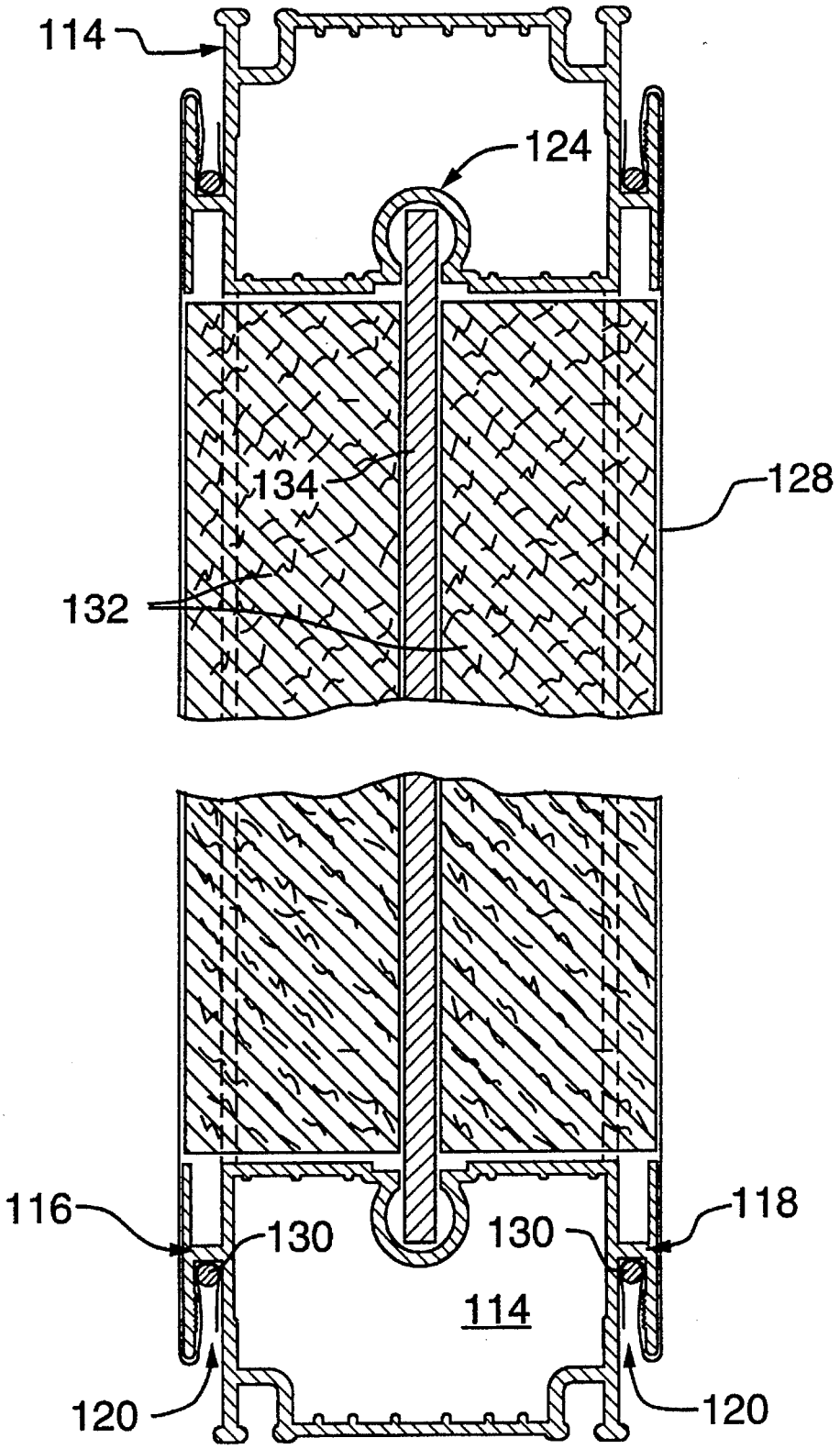

As best seen in FIG. 12, the horizontal frame members 114 have a cross-sectional shape that is very similar to the vertical frame members 112 except for the absence of formations on the outer face of the member. Members 114 are also hollow metal extrusions and have essentially the same outwardly spaced lateral webs as the webs 40 and 42 shown in FIG. 1 and the same inwardly directed groove or slot at the inner face of the extrusion as that shown at 32 in FIG. 1. In FIG. 12, the webs are denoted respectively 116 and 118 and define slots 120. The inwardly directed groove similar to groove 32 is denoted 124. In FIG. 11, primed reference numerals have been used to denote parts of the vertical frame member 112 which correspond to the parts shown in FIGS. 1 to 3. Thus, member 112 has respective webs 40' and 42' defining slots 46' and an inwardly directed groove 32'.

Figure 10:
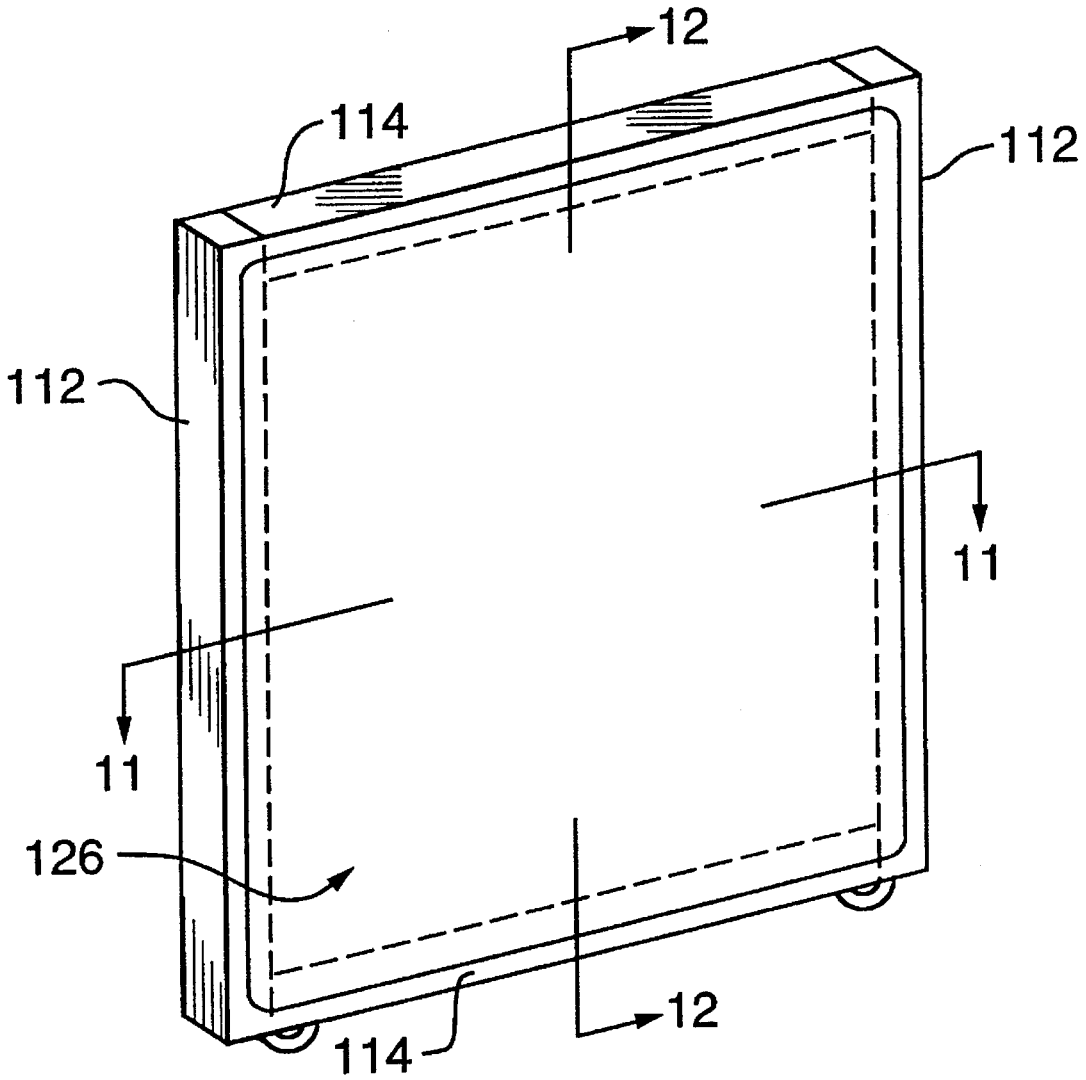
FIG. 10 is a simplified perspective view of a further preferred form of panel structure in accordance with the invention.

It will be appreciated from consideration of FIGS. 10 to 12 that, in the assembled frame, the grooves 32' (FIG. 11) and 124 (FIG. 12) co-operate to define a continuous inwardly facing slot around the inner perimeter of the frame of the panel structure. Similarly, the external webs 40', 42' (FIG. 11) and 116, 118 (FIG. 12) co-operate to define what is essentially a "sub-frame" spaced outwardly from the major sidewalls of the respective extrusions, and defining with those sidewalls an encircling slot comprising the slots 46' (FIG. 11) and 120 (FIG. 12). These features permit a completed panel to be assembled to provide a variety of different surface finishes such, for example, as an upholstered panel finish such as that indicated by reference numeral 126 in FIG. 10.

As will be described in more detail in connection with FIGS. 11 and 12, the external upholstered finish is provided by a fabric panel that is stretched over the sub-frame provided by the webs 40', 42', 116 and 118. The marginal edge portions of the panel are then tucked into the slots 46' and 120 and retained by a resilient O-ring that is frictionally fitted into the encircling slot. In FIGS. 11 and 12, a fabric panel of this type is indicated by reference numeral 128 and is shown retained by an essentially continuous rubber O-ring 130. Inwardly of the fabric panel 128 is an insulating fibreglass panel 132 supported by a relatively rigid central panel 134, for example of wood or reconstituted wood product. This panel is simply received within the inwardly facing grooves 32' and 124 of the respective extrusions. In assembling the panel, three of the extrusions are first fitted together, panel 134 is inserted into the grooves in those three extrusions and the fourth extrusion is then added to complete the frame.

Figure 13:
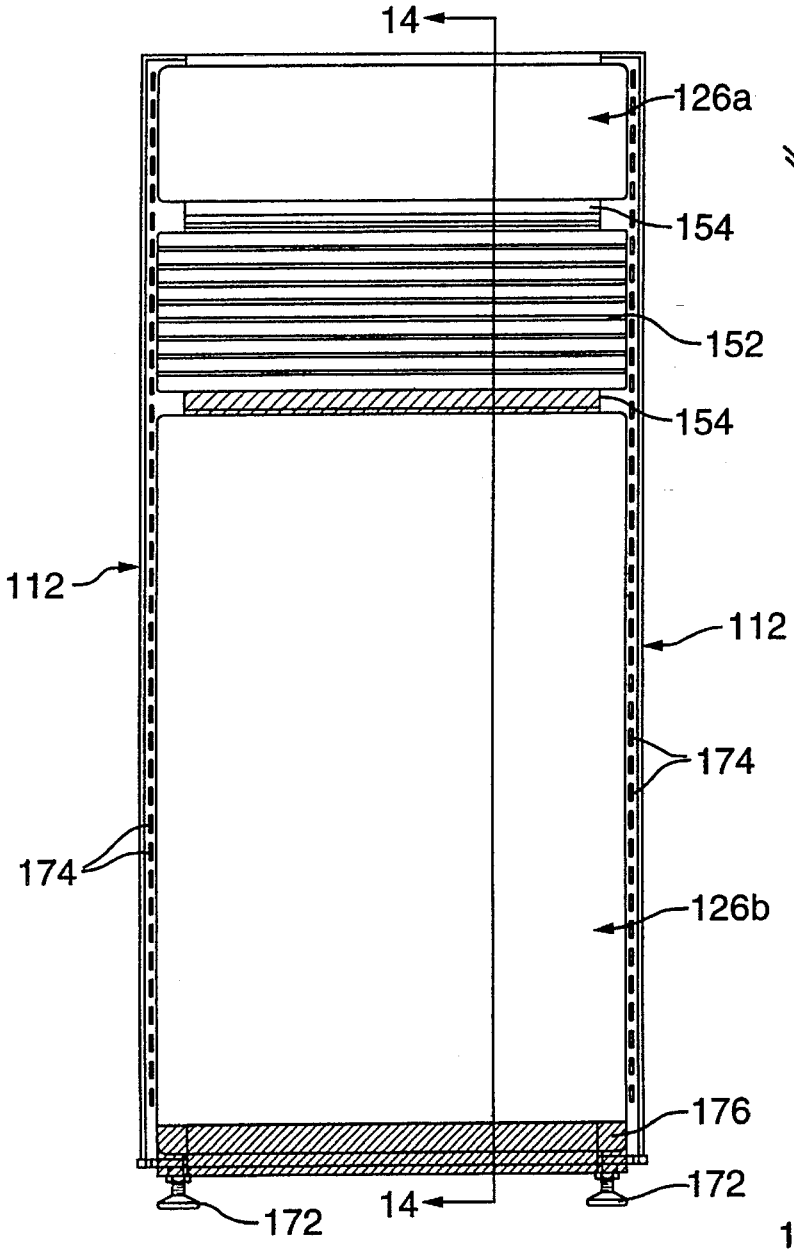
FIG. 13 is an elevational view of a further preferred form of the panel structure shown in FIG. 10.
Figure 14:
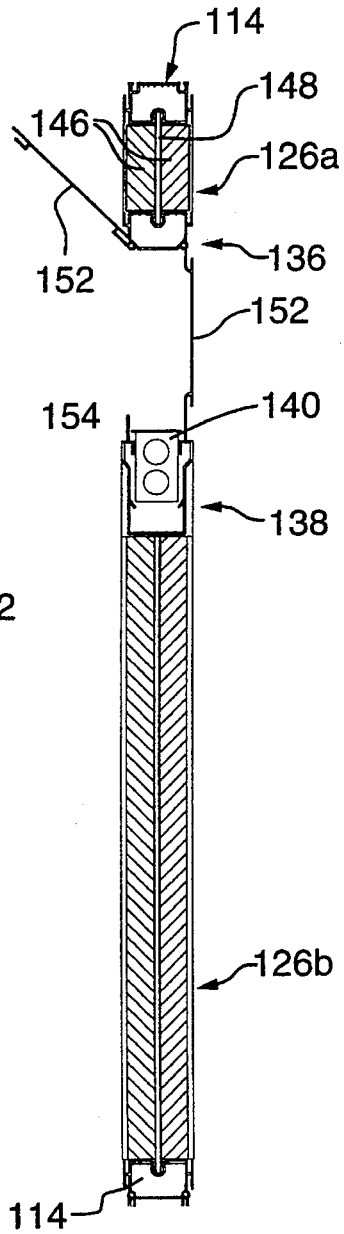
FIG. 14 is vertical sectional view on line 14—14 of FIG. 13.

FIGS. 13 and 14 show a somewhat more complex form of panel structure in accordance with the invention. In the FIG. 13 embodiment, the panel structure has two upholstered sections denoted respectively **126*a* and 126*b*, each of which is formed in similar fashion to the upholstered section 126 of FIG. 10, by using additional horizontal extrusions at the bottom of the upper section 126*a* and at the top of the lower section 126*b* respectively. Those additional extrusions are shown at 136 and 138 respectively in FIG. 14. The space between those extrusions forms a raceway for receiving cables such power, telephone and computer communication cables. Openings in the vertical frame members 112 provide access to the raceway. Again, the two extrusions 136 and 138 have cross-sectional shapes that replicate the outwardly spaced webs or flanges 40 and 42 of the extrusions shown in FIG. 1, and an inwardly facing groove similar to groove 32 of FIG. 1. This allows the upholstered panel sections to be formed as described previously in connection with FIGS. 10 to 12**.

Figure 16:
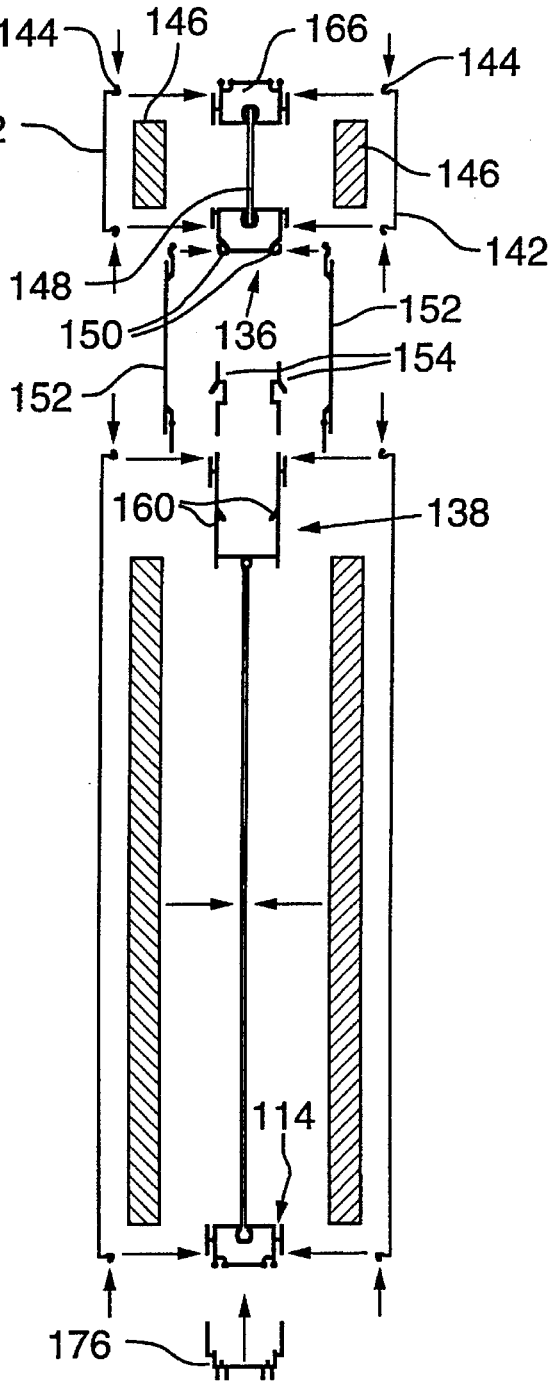

FIG. 16 is useful in showing an exploded view corresponding to FIG. 14, from which the precise cross-sectional shapes of the various extrusions can be seen. Extrusion 138 is somewhat deeper than the other extrusions in order to accommodate cabling, electrical boxes, etc. but has essentially the same external features. A typical electrical box is shown in FIG. 14 at 140. In FIG. 16, fabric panels for forming the top upholstered section **126*a* are shown at 142 together with associated O-rings 144. Insulating fibreglass panels are shown at 146 and a rigid central panel is indicated at 148**.

Similar components are also shown for the bottom upholstered panel section **126*b*** but have not been individually designated.

FIG. 16 also shows that the upper intermediate extrusion 136 is also provided with channels 150 at the bottom into which are hooked respective plastic extrusions 152 forming hinged covers for the raceway. One of those extrusions is visible in elevation in FIG. 13. Further extrusions 154 (FIG. 16) snap onto the top edge of the lower intermediate extrusion 138 to provide mating surfaces onto which the covers 152 can be snapped at their lower ends.

Figure 15:
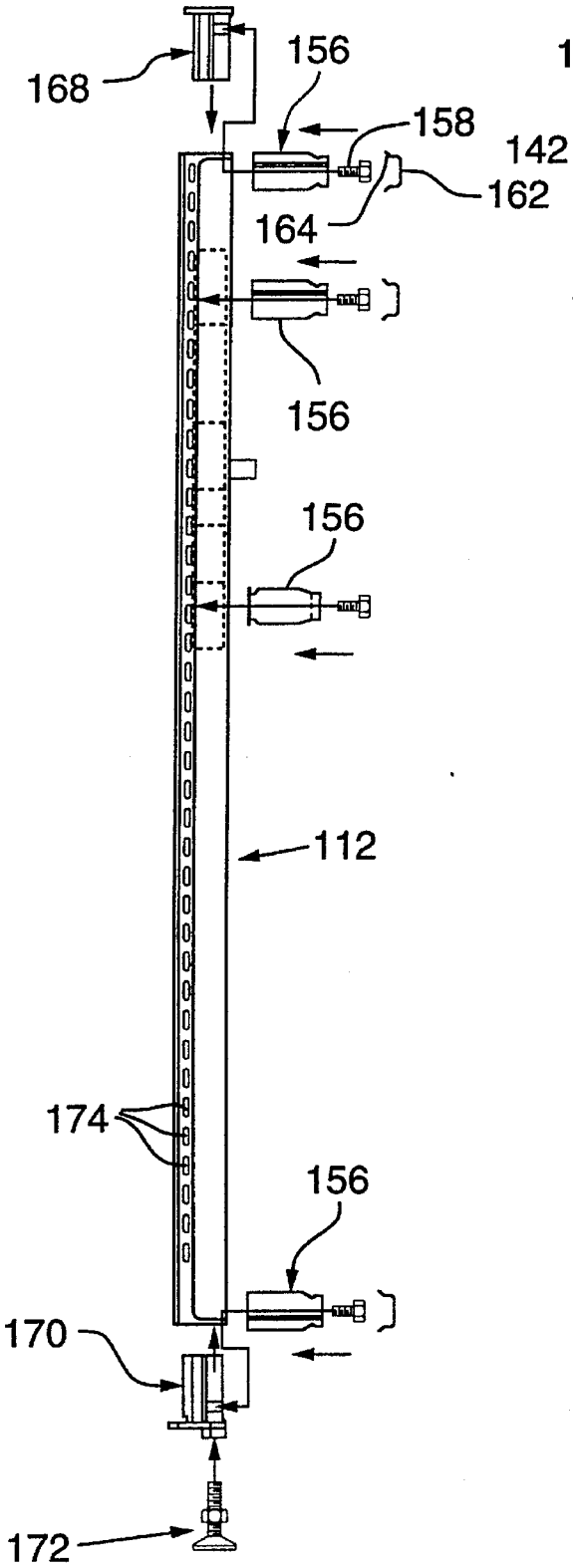
FIGS. 15 and 16 are exploded views corresponding respectively to the left-hand side of FIG. 13 and to FIG. 14.

FIG. 15 illustrates the method of interconnecting the horizontal and vertical extrusions to form the rigid frame of the panel structure. Essentially, "plugs" or "fingers" that are shaped to fit closely into the horizontal frame members are bolted to the vertical frame members at the appropriate locations. In FIG. 15, four of those plugs are provided and are individually denoted by reference numeral 156. Bolts for securing the plugs to the vertical frame member 112 are indicated at 158. The cross-sectional shape of the plugs has not been illustrated in detail; suffice it to say, that the shape is complementary to the internal cross-sectional shapes of the extrusions shown in FIG. 16. The lower intermediate extrusion 138 is provided with inwardly directed flange portions 160 so that the lower part of the extrusion has the same internal cross-sectional shape as the other three extrusions; accordingly, the plug for extrusion 138 can be identical with the other plugs.

The plugs are designed so that a spring clip 162 can be snap-fitted over the outer end of each plug. The spring clip has projecting outer edges 164 that "bite" into the relevant internal surface portions of the respective extrusions to inhibit withdrawal of the plug once it has been fully inserted. Typically, the extrusions are made of aluminum and are provided with internal ribbing such as that indicated at 166 in FIG. 16, to provide surfaces for engagement by the edges of the clip 162.

FIG. 15 also shows top and bottom corner caps 168 and 170 respectively that are fitted into the ends of the vertical extrusion 112 to provide a "clean" finish. Again, the configuration of the caps has not been shown in detail; the caps are shaped to be essentially complementary to and plug into the interior cross-sectional shape of the extrusion 112, and have a plain flat outer surface. The bottom cap 170 is threaded to receive an adjustable leveller 172.

FIG. 15 (as well as FIG. 13) shows the presence of longitudinally extending slots 174 in the main sidewalls of the extrusion 112 (for example generally in the area denoted by reference numeral 174 in FIG. 1) for receiving shelf supports or other fixtures that are to be hung from the panel structure.

Finally, FIG. 16 shows a plastic "kick plate" extrusion 176 that is fitted over the lower horizontal frame member 114 in the assembled panel structure.

In the embodiments previously described, the panel structure is essentially opaque. The configuration, size and number of the upholstered panel sections such as sections **126*a* and 126*b* can be changed as required to provide an almost infinite variety of designs. Different fabrics or other coverings can be used. It is also possible to incorporate a window in the panel structure either in place of an upholstered section or occupying the whole of the area of the panel structure within the external frame. Referring to FIGS. 11 and 12, this may be accomplished by omitting the fabric panels as pane]. 128 and the fibreglass panels 132 and by replacing the inner rigid panel 134** with a glass or transparent plastic panel.

Figure 17:
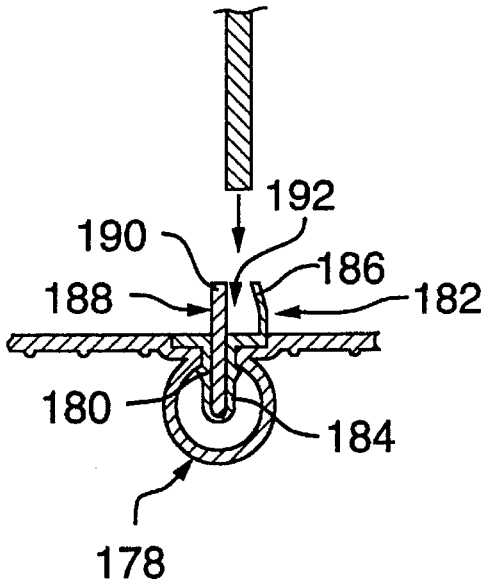
FIG. 17 is a detail sectional view of a seal that may be used in the panel structure of the invention; and, FIG. 18 is a horizontal sectional view through a post that may be used with the panel structures of any of the illustrated embodiments.

FIG. 17 shows a seal arrangement for accommodating the marginal edges of a transparent panel within the inwardly facing grooves such as the groove 32' (FIG. 11) or 124 (FIG. 12). In FIG. 17, reference numeral 178 denotes part of any one of the extrusions described previously that includes such an inwardly facing groove. Fitted into the groove through its mouth 180 is a seal structure comprising a relatively soft and flexible seal extrusion 182 having a U-shaped portion 184 designed to fit within the mouth 180 of the groove, and an upstanding lip 186 that will project outwardly of the inner face of the extrusion in question. A second but relatively much harder, generally planar extrusion 188 is designed to be fitted into the extrusion 182 between the limbs of the U-shaped portion 184. Extrusion 188 provides a lip portion 190 that is spaced from and generally parallel to the lip portion 186 of extrusion 182, forming therewith a generally channel-shaped recess 192 for receiving a marginal edge portion of a transparent panel such as that indicated 194. The two extrusions would of course extend continuously around the window opening, providing an effective edge seal for the whole of the perimeter of the panel.

Figure 18:
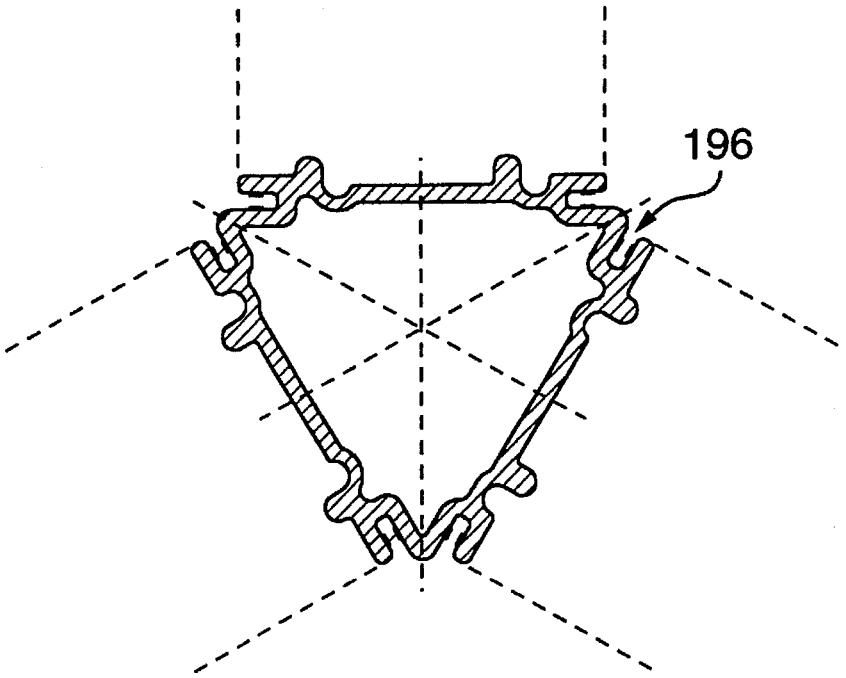

Finally, FIG. 18 shows, in transverse cross-section, a post 196 that may be used to join together two or more panels that are not required to be co-planar with one another. In this embodiment, post 196 is triangular in cross-section and has three identical faces, each of which is shaped to replicate the contour of the outer face of the vertical frame member such as the face 12 that appears at the right-hand side of FIG. 1. Any panel structure can then be simply engaged with the complementary formations on the relevant face of post 196 and the panel structure attached to the post by means of locking members such as those shown in FIGS. 4 and 5. The chain-dotted outlines in FIG. 18 show the positions that would be occupied by three panel structures coupled to the three faces of the triangular post. It will be course be understood that the post could also be square or have more than four similar faces for attachment of panel structures thereto. Conversely, only two faces of a triangular post could be used as panel attachment faces and the angular relationship between those two faces varied to provide for different relative angular relationships between the two faces.

It will of course be appreciated that the preceding description relates to particular preferred embodiments of the invention and that many modifications are possible within the broad scope of the invention. Some of those modifications have been specifically indicated and others will be apparent to a person skilled in the art.

We claim:

1. A frame member for a divider, screen or other panel structure, the member being of elongate form and having a side surface adapted to co-operate with a like side surface of a second similar frame member, said side surface having two formations which extend longitudinally of the member, each said formation being of uniform cross-sectional shape throughout its length and comprising a projection and a complementary recess, said projection and recess of each formation being disposed on respectively opposite sides of and symmetrically with respect to a longitudinal median plane of the member which extends normal to said surface, and the projection of each formation being disposed immediately adjacent to the recess of the other formation, the frame member further including means for receiving a locking member for maintaining the frame member in side-by-side relationship with a said second similar frame member with the said side surfaces of the respective members in abutment, whereby the said formations of the side surfaces of the respective frame members inter-engage for preventing relative lateral movement therebetween.

2. A frame member as claimed in claim 1, including laterally extending slots at respective ends of said side surface, providing said means for receiving a locking member.

3. A frame member as claimed in claim 1, including a second side surface parallel to the first-mentioned side surface and having an inwardly extending groove with a narrow neck.

4. A frame member as claimed in claim 1, including end surfaces extending generally normal to said side surface, a web on each end surface spaced from said end surface, to define a slot.

5. A frame member as claimed in claim 1, in the form of a hollow extrusion.

6. A panel structure having a frame which includes upright frame members at opposite ends of the structure, each upright frame member being of elongate form and having a first side surface facing outwardly of the panel structure and including two formations which extend longitudinally of the member, each said formation being of uniform cross-sectional shape throughout its length and comprising a projection and a complementary recess, said projection and recess being disposed on respectively opposite sides of and symmetrically with respect to a longitudinal median plane of the member which extends normal to said surface, and the projection of each formation being disposed immediately adjacent to the recess of the other formation, the upright frame member further including means for receiving a locking member for connecting said panel structure to an adjacent similar panel structure.

7. A panel structure as claimed in claim 6, wherein each said upright frame member includes laterally extending slots at respective ends of said first side surface, providing said means for receiving a locking member.

8. A panel structure as claimed in claim 6, wherein each said upright frame member includes a second side surface parallel to the first side surface and having an inwardly extending groove with a narrow neck.

9. A panel structure as claimed in claim 8, wherein each said upright frame member includes end surfaces extending generally normal to side said surfaces, a web on each end surface spaced form said end surface, to define a slot.

10. A panel structure as claimed in claim 8, further comprising at least two horizontal frame members extending between and coupled to said upright frame members, said horizontal frame members being disposed in spaced parallel positions, and each of said horizontal frame members having an inner side surface provided with an inwardly extending groove, whereby the grooves of all of the frame members co-operate to define a continuous groove, and wherein a transparent panel providing a window in said panel structure is located within the frame with marginal portions of said panel received in said continuous groove.

11. A panel structure as claimed in claim 6, wherein each said upright frame member comprises a hollow extrusion.

12. A panel structure as claimed in claim 6, wherein said frame further comprising horizontal frame members extending between the upright frame members at least at the top and bottom of the panel structure, and means providing at least one upholstered section at the front or rear of the structure.

13. A panel structure as claimed in claim 12, wherein each of said upright frame members and each of said horizontal frame members has a cross-sectional shape comprising first and second parallel side surfaces, and first and second parallel end surfaces extending between the side surfaces, the first side surfaces of each upright member facing outwardly of the panel structure and including said two formations, at least one formation, wherein the second side surfaces of each upright frame member and the corresponding side surface of each horizontal frame member includes a groove which extends longitudinally of the member, whereby the said grooves co-operate to form a continuous groove.

14. A panel structure as claimed in claim 13, wherein said means providing at least one upholstered section includes a web which extends longitudinally of and spaced outwardly from each end surface of each of said upright frame members and each of said horizontal frame members, each said web being coupled to the relevant end surface so as to define a slot that opens in a direction outwardly of said frame, the webs of all of the frame members at each of the front and rear of the panel structure co-operating to define a sub-frame spaced outwardly from the end surfaces of the frame members and surrounded by said slots, and, tensioned over at least one of said sub-frames, a fabric panel which includes marginal portions retained in said slots by a resilient element frictionally received therein.

15. A panel structure as claimed in claim 14, wherein said means providing at least one upholstered section further includes a relatively rigid panel having marginal portions engaged in said groove facing inwardly of said frame, and an insulating panel disposed in the space between said relatively rigid panel and said fabric panel.

16. A panel structure as claimed in claim 13, further comprising at least two intermediate horizontal frame members extending between the upright frame members parallel to said top and bottom frame members, wherein the panel structure is provided with at least two upholstered sections, each extending respectively between one of said intermediate horizontal frame members and the top or bottom said horizontal frame member.

17. A panel structure as claimed in claim 16, wherein a lower one of said intermediate horizontal frame members is spaced below an upper one of said intermediate horizontal frame members and provides a raceway for receiving cables and the like, and wherein the panel structure further includes removable cover means for said raceway extending between said intermediate horizontal frame members.

18. A panel structure as claimed in claim 12, wherein each of said horizontal and upright frame members is a hollow extrusion, and wherein the horizontal frame members are rigidly coupled to the upright frame members at each junction therebetween, by a plug-like member which is secured to the upright frame member and frictionally retained within the cross-section of the horizontal frame member.

19. A panel structure as claimed in claim 6 in combination with a second similar panel structure, wherein one of said upright frame member at one end of one of said panel structure is maintained in side-by-side relationship and locked to a corresponding said upright frame member at an adjacent end of the other panel structure with the side surfaces of the respective upright frame members in abutment and the said formations of the side surfaces of the respective upright frame members inter-engaged for preventing relative lateral movement therebetween, the combination further comprising at least one locking member connecting said side-by-side upright frame members.

20. A combination as claimed in claim 19, wherein the panel structures are connected together through the intermediary of a post having respective side surfaces that are disposed in a selected angular relationship as seen in transverse cross-section corresponding to the required angular relationship between the panel structures as seen in plan, each said surface of the post being provided with two formations replicating said at least one formation on the adjacent upright frame members of the respective panel structures, whereby the upright frame members inter-engage with said faces of the post in essentially the same fashion as the upright frame members could inter-engage with one another in the absence of the post.

* * * * *